United States Patent [19]

Marsden

[11] Patent Number: 5,020,956

[45] Date of Patent: Jun. 4, 1991

[54] OPEN HOPPER BARGE UNLOADING SYSTEM

[75] Inventor: John Marsden, Cutoff, La.

[73] Assignee: Margrif Design Corporation, Destrehan, La.

[21] Appl. No.: 234,340

[22] Filed: Aug. 19, 1988

[51] Int. Cl.[5] ..... B63B 27/00

[52] U.S. Cl. ..... 414/138.1; 414/139.8; 414/140.6

[58] Field of Search ..... 414/138.1, 138.8, 139.8, 414/140.6, 140.9, 142.2, 356, 359, 360, 574, 576, 786, 744.3, 744.6

[56] References Cited

U.S. PATENT DOCUMENTS

| | | | |
|---|---|---|---|
| 162,695 | 4/1875 | Safely | 414/138.1 |
| 710,194 | 9/1902 | Hughes | 414/140.6 X |
| 1,823,172 | 9/1931 | Schon . | |
| 3,270,698 | 9/1966 | Fort | 114/5 |
| 3,429,461 | 2/1969 | Fenchel | 414/140.6 X |
| 3,537,600 | 11/1970 | Schuchmann | 414/140.6 |
| 3,687,307 | 8/1972 | Macrander et al. | 414/140.6 |
| 4,072,119 | 2/1978 | Williams | 114/45 |
| 4,084,529 | 4/1978 | Katernberg | 114/46 |

FOREIGN PATENT DOCUMENTS

| | | | |
|---|---|---|---|
| 1300883 | 7/1962 | France | 414/139.8 |
| 244343 | 12/1925 | United Kingdom | 414/140.6 |
| 477625 | 1/1938 | United Kingdom | 414/139.8 |
| 1213628 | 11/1970 | United Kingdom | 414/139.8 |

*Primary Examiner*—Joseph E. Valenza
*Assistant Examiner*—Boris Milef
*Attorney, Agent, or Firm*—C. Emmett Pugh

[57] ABSTRACT

A floating, barge unloader system by which open hopper barges containing granular materials are rapidly unloaded by picking up, rotating the barge and dumping its contents. The open, loaded hopper barge is positioned above a lowered barge lifting platform and secured to it by latch beams and hydraulic clamps. Compressed air is released into the ballast tanks of the barge lifting platform, forcing the ballast water from the tanks, causing the barge lifting platform with the barge secured on it to rise along guide rails. Hydraulically operated, rotating arms affixed to the support structure upon which the guide assembly is mounted attach to the barge lifting platform and rotate the barge lifting platform with the mounted barge and up and about the guide assembly, including pivot elements located along the sides of said support structure during the pivoting of the barge/platform up approximately one hundred angular degrees. The contents of the open hopper barge are dumped onto conveyor(s), which can be situated in the support structure. Once the open hopper barge is emptied, the barge lifting platform with the emptied barge is returned to an upright position, and the hydraulically operated arms and latch beams and hydraulic clamps are released. The ballast tanks of the barge lifting platform are then flooded, causing the barge lifting platform to sink along the guide assembly, below the floating level of the emptied barge. The empty open hopper barge is then flaoted free from the barge lifting platform.

11 Claims, 5 Drawing Sheets

OPEN HOPPER BARGE UNLOADING SYSTEM

BACKGROUND OF INVENTION

1. Field of Invention

This present invention relates to a superior means to rapidly unload open hopper barges. In particular the present invention relates to a system for unloading granular type materials in an open hopper barge by picking it up, rotating it over and dumping out in a bulk fashion its granular type materials.

2. Prior Art

The art of emptying open hopper barges of their granular contents ranges from the use of, more commonly, single bucket cranes, multiple bucket conveyors, and multiple bucket wheels, to a few, relatively rare barge or other vessel upsetting types of systems, which broadly speaking is the general type of approach employed in the present invention.

With respect to the the bucket unloading systems of the prior art they do not act directly upon the open hopper barge. In all cases the open hopper barge remains afloat in the operating area of the bucket unloading system, and the buckets extract in very limited, discrete portions the granular material from the open hopper barge.

The barge or other type of vessel upsetting systems do act by various means directly upon the open hopper barge or vessel. The prior systems know to applicant have employed:

a cable lifting system, wherein the barge is secured within a carrier, which then is lifted and tilted within tracks by means of the lifting cables (note U.S. Pat. No. 710,194 to H. N. Hughes issued Sept. 30, 1902);

a rotating cylinder system, wherein the barge or other vessel is secured in a trough supported within a cylinder, which cylinder is rotated by means of a gear mechanism (note U.S. Pat. No. 1,823,172 to K. Schon issued Sept. 15, 1931); and an inclined track system, wherein the barge is secured in a carrier which is translated by rack gears along a ramp to a rolling unit which is then rotated by cables (note U.S. Pat. No. 3,537,600 to Commodore A. Schullmann issued Nov. 3, 1970).

The broader art associated with generaly lifting a vessel from the water in which it is floating, for example as a dry dock, has been addressed by, for examples, the following patents:

| U.S. Pat. No. | Inventor | Issued |
|---|---|---|
| 3,270,698 | M. R. Fort | Sept. 6. 1966 |
| 4,072,119 | B. V. Williams | Feb. 7, 1978 |
| 4,084,529 | H. Katernberg | Apr. 18. 1978 |

The bucket unloading type systems of the prior art may be either a mobile facility or a fixed installation and may unload the open hopper barge into a floating or a land-based receiver. However, the unloading bucket systems are relatively slow and adversely affect the turn-around time of the open hopper barge.

The barge upsetting type systems of the prior art are relatively expensive and complex fixed installations, which unload only into land based receivers. Additionally, these prior art systems are not as reliable or as practical or as efficacious as the present invention.

3. General Discussion of the Invention

It is therefore an object of the present invention to provide a relatively uncomplicated, safe and reliable floating barge unloader system wherein open hopper barges containing granular materials are rapidly unloaded by rotating the barge and dumping in bulk its contents.

It is another object of the present invention to provide a floating barge unloader system wherein open hopper barges are unloaded by rotating the barges and dumping their contents and which may be either a mobile facility or a fixed installation for unloading into either an along-shore land-based or a water based facility.

It is still another object of the present invention to provide a floating barge unloader system wherein open hopper barges are unloaded by rotating the barge and dumping its contents and which unload to a floating receiver or a land-based receptacle.

It achieves all this with a system that operates reliably even with a significant variation in water level by causing the loaded, secured barge to be carried by a floatable platform and preferrably pivoted over about a pivot bar or roller type element mounted to the basic support structure, which pivot element engages the barge along its side closest to the unloading facility. The system also preferrably uses a series of guide rail and roller assemblies and one or more rotating arms that pulls the loaded barge up and over the pivot bar or roller. Other particular efficacious mechanical sub-systems and latching and clamping elements for securing the barge to the barge supporting platform are disclosed and preferrable used.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein.

DETAILED DESCRIPTION OF THE PREFERRED EXEMPLARY EMBODIMENT(S)

Structure

Figure 1:
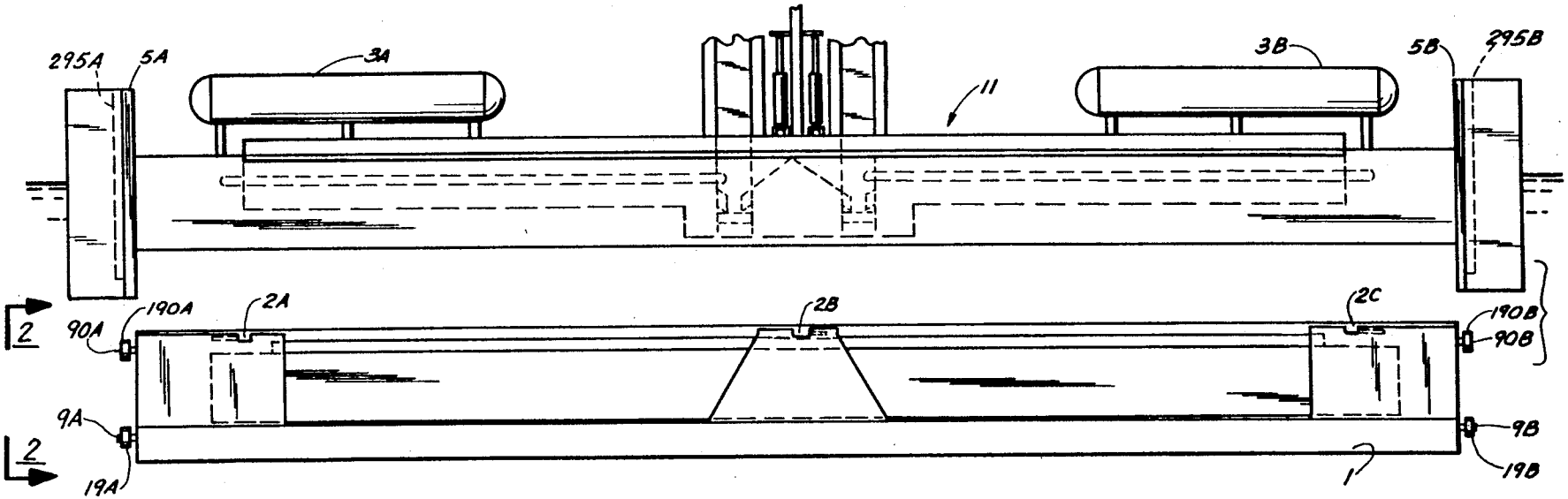
FIG. 1 is a front, exploded view of the preferred embodiment of the floating barge unloader system of the present invention which shows the basic elements of the system with the floating platform "exploded" or move downwardly to expose the front view of the loading facility.
Figure 3:
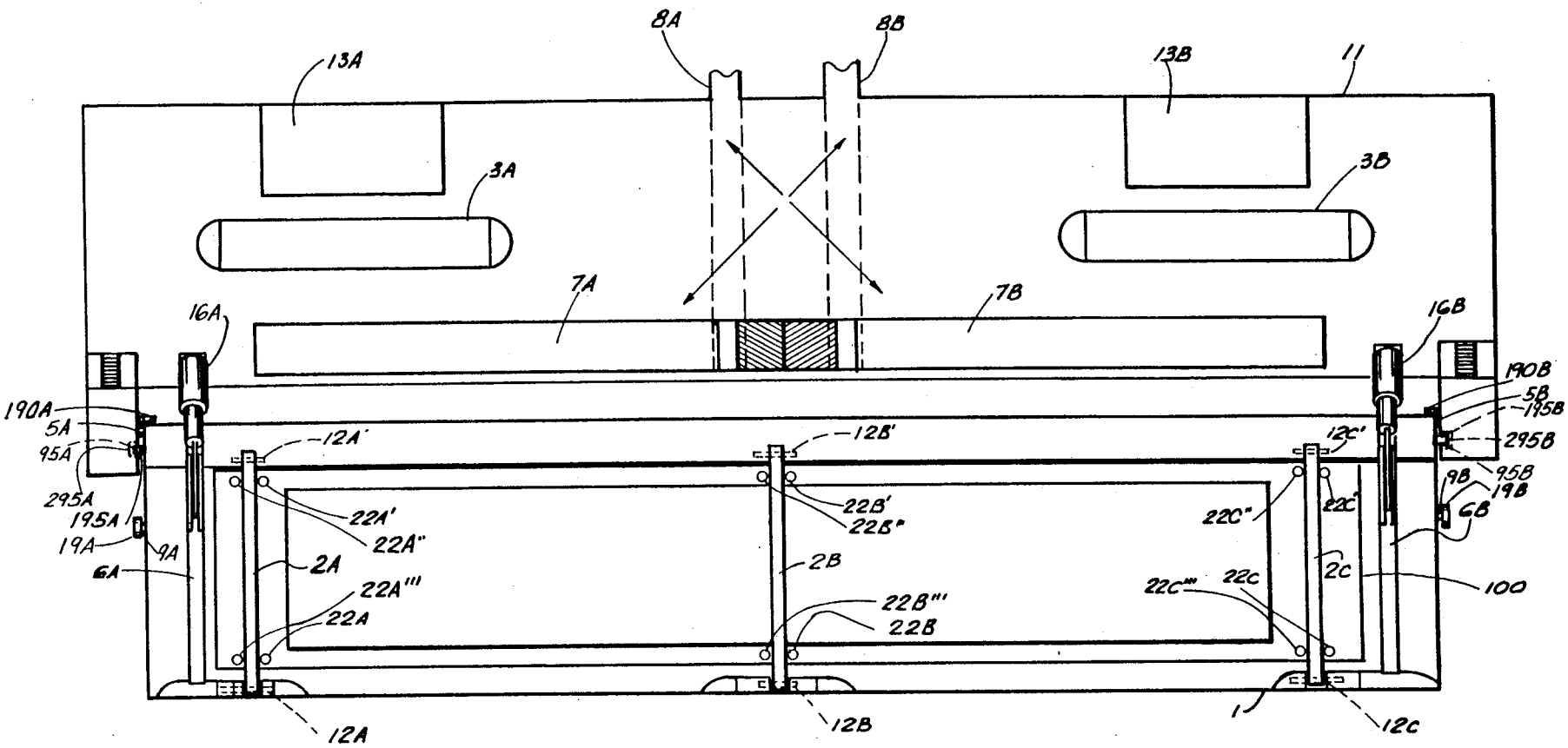
FIG. 3 is a plan view of the preferred embodiment presented in FIG. 1.

Referring to FIGS. 1 and 3 there are shown a front ("exploded") view, an elevated view and a plan view, respectively, of the preferred embodiment of the floating barge unloader system of the present invention.

Figure 2:
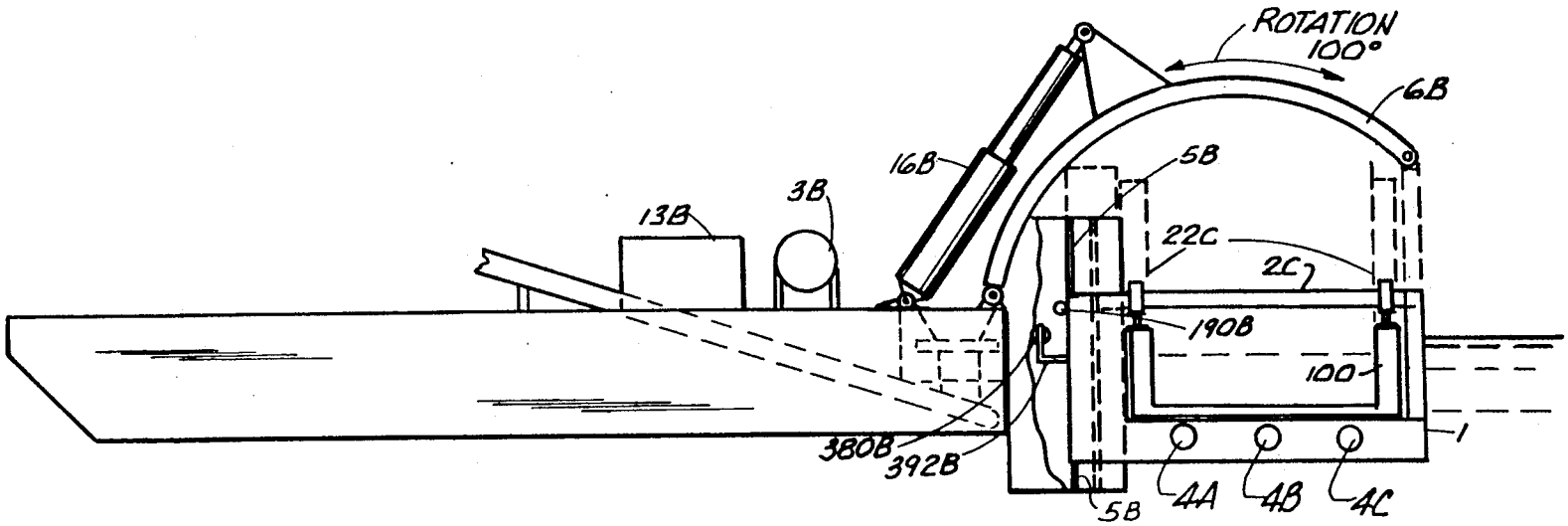
FIG. 2 is a side elevated view of the preferred embodiment presented in FIG. 1 with the floating platform and its loaded barge down in its lower disposition and with the near side wall partially cut away and with the floating platform shown in cross-section along section lines 2—2 of FIGS. 1 and 3.

The floating barge lifting platform 1 in its initial, lowered or sunken position (note generally FIG. 2) receives over it the floating, loaded, open hopper barge 100 to be unloaded. Latch beams 2A, 2B & 2C, fitted to the floating barge lifting platform 1 by means of anchoring pivot pins 12A', 12B', 12C', respectively, rotate about the anchoring pins 12A', 12B', 12C', respectively, span the opening of the floating barge lifting platform 1 in the transverse direction and secure at the free end to the floating barge lifting platform 1 by securing pins 12A, 12B, 12C, respectively. The latch beams 2A, 2B, 2C are fitted with hydraulic clamps 22A, 22A', 22A'', 22A''', 22B, 22B', 22B'', 22B''', 22C, 22C', 22C'', 22C''', respectively, which when actuated extend downwardly and seat against the upper surface of the open hopper barge 100 positioned within the floating barge lifting platform 1.

Figure 4:
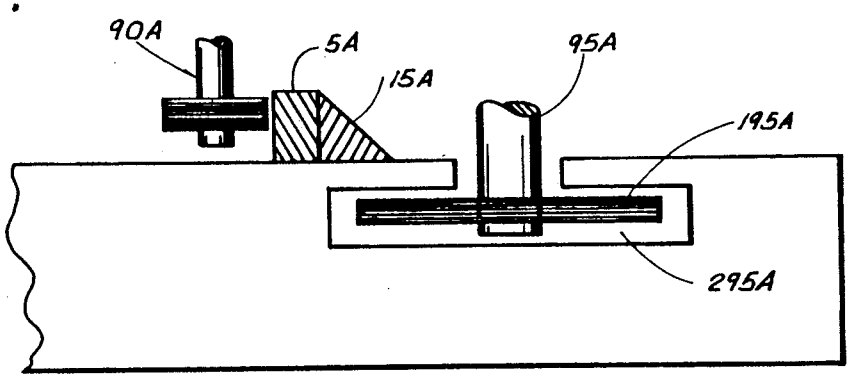
FIG. 4 is a detailed, plan, view of the barge lifting platform roller assembly and guide assembly on one side of the preferred embodiment presented in FIG. 1.

The floating barge lifting platform 1 is attached to the floating support structure 11 by means of a guide assembly as depicted in detail in the plan view of FIG. 4. Roller posts 90A, 90B and 95A, 95B (see also FIGS. 1 and 3) are fitted to the floating barge lifting platform 1 and are themselves fitted with rollers 190A, 190B and 195A, 195B, respectively. The rollers 195A, 195B travel within slots 295A, 295B, respectively, fitted in the floating support structure 11.

Rollers 190A, 190B travel along external guides fitted to the floating support structure 11. The external guides are comprised of guide rails 5A, 5B (note FIGS. 2 and 2A), against which rollers 190A, 190B respectively, roll, and adjoining bracing (see 15A in FIG. 4), which supports the guide rails 5A, 5B, respectively.

The floating barge lifting platform 1 is outfitted with ballast tanks 4A, 4B and 4C (note FIGS. 2 and 2A), which, when evacuated by compressed air, result in the then more bouyant, floating barge lifting platform 1 rising in the water relative to the floating support structure 11 and the waterline (W.L.) along the guide assembly incorporated in the floating support structure 11.

Situated on the floating support structure 11 are tank receivers 3A, 3B (note FIG. 3), which store the compressed air needed to evacuate the ballast tanks 4A, 4B and 4C. The compressed air is created in the compressor rooms 13A, 13B, respectively, also situated on the floating support structure 11.

The floating support structure 11 is outfitted with rotating arms 6A, 6B (note FIGS. 2, 2A and 3), which attach to the floating barge lifting platform 1 to impart an upsetting force to the floating barge lifting platform 1. Hydraulic rams 16A, 16B are secured at their fixed ends to the floating support structure 11 and at their free ends to the rotating arms 6A, 6B, respectively. Extension of the hydraulic rams 16A, 16B positions the rotating arms 6A, 6B to attach to the floating barge lifting platform 1. Contraction of the hydraulic rams 16A, 16B transmits a force through the rotating arms 6A, 6B, respectively, to the floating barge lifting platform 1, resulting in a pulling rotation of the floating barge lifting platform 1. Roller posts 9A, 9B fitted to the floating barge lifting platform 1 and fitted themselves with rollers 19A, 19B, respectively, and roller posts 90A, 90B fitted to the floating barge lifting platform 1 and fitted themselves with rollers 190A, 190B, respectively, contact the guide rails 5A, 5B, respectively, when the floating barge lifting platform 1 has rotated through an arc of approximately one hundred angular degrees, serving effectively as a mechanical stop.

Figure 2A:
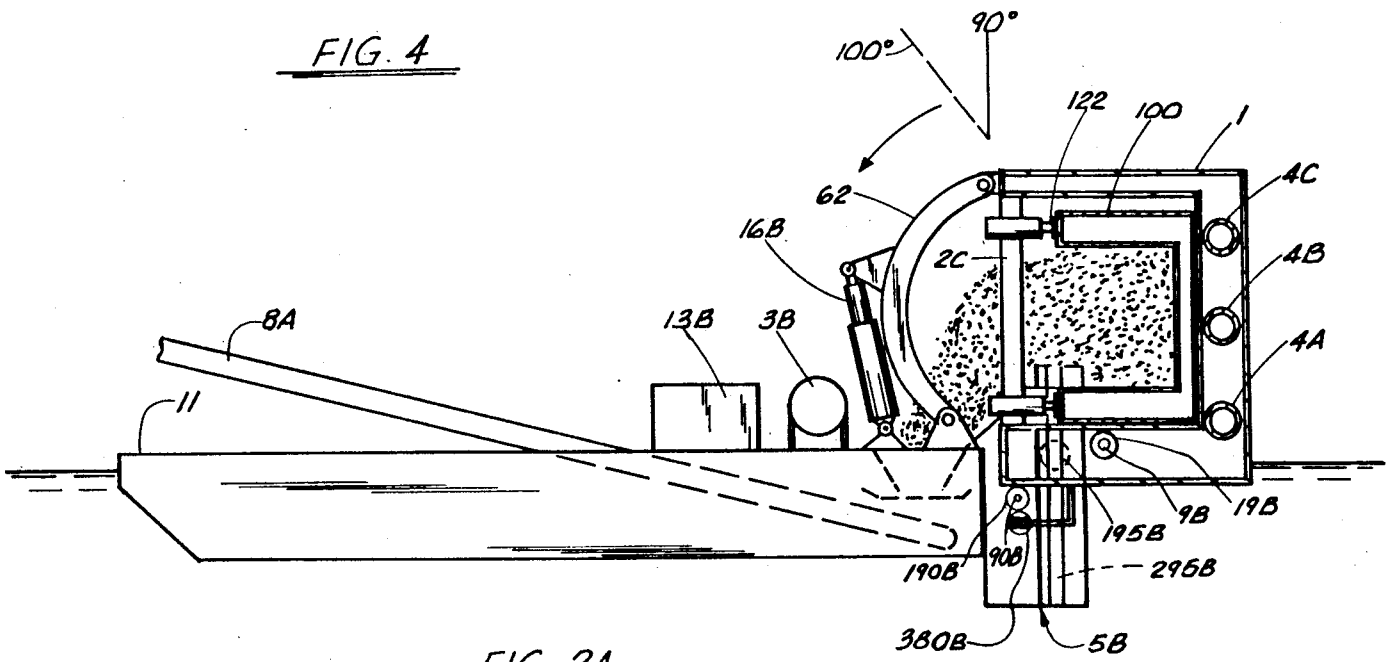
FIG. 2A is a partial view similar to FIG. 2 but showing the now elevated platform with its secured loaded barge raised to its upper, ninety degree position just ten degrees short of its maximum inverted disposition.
Figure 5B:
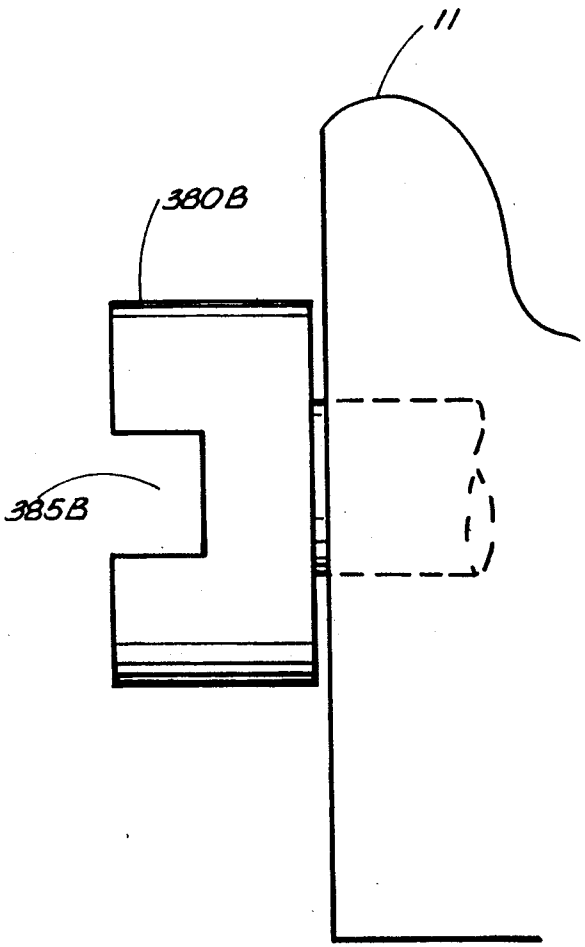
FIGS. 5A and B are partial, detail end and plan views, respectively, of the cantilever, stop and swell dampening sub-system, which is operative when the floating platform reaches its maximum vertical buoyancy position.
Figure 5A:
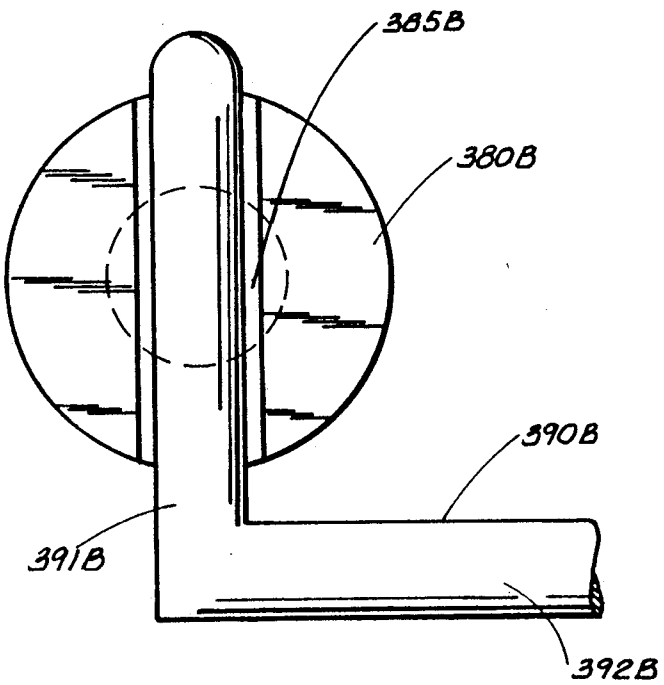

It is noted that "L" shaped cantilever members (the far one 390B being illusted in FIGS. 2, 2A and 5) are provided on the ends of the floating platform 1 which cantilevers in the disposition of FIG. 2A (and right therebefore and thereafter) serves as vertical stops to limit the amount of vertical movement on the unloading side of the platform/barge 1/100 and as water swell dampening members. As can be seen in the partial, detail views of FIGS. 5A and 5B, the upper leg 391B of the cantilever member 390B moves into the slot 385B in the oscillatable stop member 380B untril the base leg 392B comes into contact with the stop member 380B, which is pined for at least one hundred degree rotation to the support structure 11. As the hydraulic arms 6A, 6B begin pulling up on the floating platform 1, the "L" shaped cantilever 390B and the stop member 380B, which are then locked together, pivot one hundred degrees together in the counter-clockwise direction as viewed from the perspective of FIG. 5A.

Situated on the floating support structure 11 are receiving conveyors 7A, 7B (note FIG. 3), onto which fall the granular contents of the open hopper barge 100, which is secured within the rotated floating barge lifting platform 1. The receiving conveyors 7A, 7B transport the granular contents to discharging conveyors 8A, 8B, respectively, which in turn transport the granular contents to their destination.

Exemplary Modifications

In an exemplary modification of the floating barge unloader system the support structure can be a fixed structure, wherein the fixed support structure is integral to the land forming the boundary of the body of water upon which the floating barge lifting platform 1 is floating.

In a further exemplary modification of the floating barge unloader system, the support structure can be a fixed structure, wherein the fixed support structure is partially integral to the land forming the boundary of the body of water, upon which the floating barge lifting platform 1 is floating and is partially supported by structure resting upon the land forming the bottom of the body of water, upon which the floating barge lifting platform 1 is floating.

In a still further modification of the floating barge unloader system, the support structure can be a fixed structure, wherein the fixed support structure is supported by a structure resting upon the land forming the bottom of the body of water, upon which the floating barge lifting platform 1 is floating.

Operation

The loaded open hopper barge 100 is floated into position within and above the floating barge lifting platform 1. The latch beams 2A, 2B & 2C are rotated about the anchoring pins 12A', 12B' and 12C', respectively, to a position above the open hopper barge 100 and are secured in position by the securing pins 12A, 12B & 12C, respectively. The hydraulic clamps 22A, 22A', 22A'', 22A''', 22B, 22B', 22B'', 22B''', 22C, 22C', 22C'', 22C''' attached to the latch beams 2A, 2B, 2C, respectively, are extended downwardly, seating against the open hopper barge 100, thereby securing the open hopper barge 100 within the floating barge lifting platform 1.

Compressed air created in the compressor rooms 13A, 13B and stored in the air receivers 3A, 3B, respectively, is discharged into the ballast of the barge floating platform tanks 4A, 4B and 4C, thereby raising the floating barge lifting platform in the water relative to the support structure 11.

The vertical movement of the floating barge lifting platform is controlled by the guide assembly. The rollers 195A, 195B travel within slots 295A, 295B, respectively, fitted in the floating support structure 11. Rollers 190A, 190B travel along external guides comprised of guide rails 5A, 5B and adjoining bracing (note 15A in FIG. 4), respectively.

The rotating arms 6A, 6B mounted on the floating support structure 11 engage to the floating barge lifting platform 1. The hydraulic rams 16A, 16B attached to the rotating arms 6A, 6B, respectively, contract, thereby pivoting the rotating arms 6A, 6B, which causes the floating barge lifting platform 1 to rotate through an arc of approximately one hundred angular degrees from its essentially horizontal floating position to a partially inverted, dumping position. When the floating barge lifting platform 1 has rotated through an arc of approximately one hundred degrees, the rollers 19A, 19B mounted on posts 190A, 190B, respectively, contact the guide rails 5A, 5B, respectively, thereby effecting a mechanical stop to the rotation.

Due to the rotation of the floating barge lifting platform 1, the granular contents of the open hopper barge 100 fall onto receiving conveyors 7A, 7B, which are located on the floating support structure 11. The receiving conveyors 7A, 7B transport the granular contents to discharging conveyors 8A, 8B, respectively, which in turn deliver the granular contents to their destination.

Once all of the granular contents have fallen from the open hopper barge 100, the hydraulic rams 16A, 16B attached to the rotating arms 6A, 6B respectively, extend, thereby pivoting the rotating arms 6A, 6B, back, causing the floating barge lifting platform 1 to rotate back down through an arc of approximately one hundred degrees and return to its essentially horizontally floating position.

The rotating arms 6A, 6B mounted on the floating support structure 11 are disengaged from the floating barge lifting platform 1. The hydraulic clamps 22A, 22A', 22A'', 22A''', 22B, 22B', 22B'', 22B''', 22C, 22C', 22C'', 22C''' attached to the latch beams 2A, 2B, 2C, respectively, are retracted upwardly, then securing pins 12A, 12B, 12C are released, and the latch beams 2A, 2B, 2C are rotated about the anchoring pins 12A', 12B' and 12C', respectively, to a position clear of the open hopper barge 100.

The ballast tanks of the floating barge floating platform 1 are vented of the compressed air, thereby permitting them to flood and thereby sinking the floating barge lifting platform 1 down in the water relative to the support structure 11 and the water line (W.L.). The empty open hopper barge 100 is then floated from the floating barge lifting platform 1 for further transport and use.

Because many varying and different embodiments may be made within the scope of the inventive concept herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A barge unloader system for rapidly unloading granular materials from an open hopper barge, comprising:

a self-contained support structure having compressed gas system means comprising a compressed gas system for creating, storing and delivering compressed gas, and associated cargo system means for handling granular materials;

a guide assembly integral to said support structure having at least one essentially vertically oriented slot and at least one essentially vertically oriented rail assembly, wherein said rail assembly is essentially parallel to said slot;

a floating barge lifting platform rotatably and translatably connected to said guide assembly having at least one slot roller post which is fitted with a slot roller which travels within said essentially vertically oriented slot, and at least one mechanical roller post which is fitted with a rail roller which travels in contact with said essentially vertically oriented rail assembly, and mechanical stop sub-system means for stopping the rotation of said platform when said floating barge lifting platform is moved to an unloading position;

raising means fitted to said floating barge lifting platform, which is operated by said compressed gas system, for elevating said floating barge lifting platform in said guide assembly relative to said support structure;

latch beam means comprising at least one latch beam pivotally attached at one end to said floating barge lifting platform, for spanning an open hopper barge positioned within said floating barge lifting platform and which is affixable at the end opposite to the pivotally attached end to said floating barge lifting platform;

clamp means comprising at least one clamp mounted on said latch beam for holding an open hopper barge in position within said floating barge lifting platform;

rotating arm means comprising at least one rotating arm pivotally attached at one end to said support structure and which attaches at the end opposite to the pivotally attached end to said floating barge lifting platform for rotating said floating barge lifting platform about said guide assembly relative to said support structure; and a power means for operating said rotating arm.

2. The barge unloader system of claim 1, wherein said self-contained support structure is a floating unit.

3. The barge unloader system of claim 1, wherein said cargo system means is a conveyor belt system having a receiving conveyor means for receiving granular materials from an open hopper barge and a discharging conveyor means for transporting granular materials from said receiving conveyor means to its destination.

4. The barge unloader system of claim 1, wherein said raising means is at least one ballast tank which is evacuated of all ballast water by the introduction of compressed gas from said compressed gas system means.

5. The barge unloader system of claim 1, wherein said clamp means is a hydraulically operated clamp.

6. The barge unloader system of claim 1, wherein said power means is a hydraulically operated arm having a fixed end and a free end which has the fixed end secured to said support structure and has the free end secured to said rotating arm.

7. The barge unloader system of claim 1, wherein said mechanical stop sub-system means includes a roller post which is fitted with a mechanical stop roller which comes into contact with said essentially vertically oriented rail assembly.

8. A barge unloader system for rapidly unloading granular materials from an open hopper barge, comprising:

a floating, self-contained support structure having compressed gas system means comprising a compressed gas system for creating, storing and delivering compressed gas and a conveyor belt cargo handling system having a receiving conveyor means for receiving granular materials from an open hopper barge and a discharging conveyor means for transporting the granular material from said receiving conveyor means to its destination, a guide assembly integral to said support structure having at least one essentially vertically oriented slot and at least one essentially vertically oriented rail assembly wherein said rail assembly is essentially parallel to said slot;

floating barge lifting platform rotatably and translatably connected to said guide assembly having at least one slot roller post which is fitted with a slot roller which travels within said essentially vertically oriented slot, at least one rail roller post which is fitted with a rail roller which travels in contact with said essentially vertically oriented rail assembly, and at least one mechanical stop roller post which is fitted with a mechanical stop roller which comes into contact with said essentially vertically oriented rail assembly when said floating barge lifting platform is rotated to an unloading position;

ballast tank means comprising at least one ballast tank fitted to said floating barge lifting platform which is evacuated of all ballast water by the introduction of compressed gas from said compressed gas system for elevating said floating barge lifting platform in said guide assembly relative to said support structure;

latch means comprising at least one latch beam pivotally attached at one end to said floating barge lifting platform, for spanning an open hopper barge positioned within said floating barge lifting platform and which is securable at the end opposite to the pivotally attached end to said floating barge lifting platform;

clamp means comprising at least one hydraulically operated clamp mounted on said latch beam for holding an open hopper barge in position within said floating barge lifting platform;

rotating arm means comprising at least one rotating arm pivotally attached at one end to said support structure and which attaches at the end opposite to the pivotally attached end to said floating barge lifting platform for rotating said floating barge lifting platform about said guide assembly relative to said support structure; and hydraulically operated ram means which has a fixed end secured to said support structure and has a free end secured to said at least one rotating arm for operating said rotating arm.

9. A method for rapidly unloading granular materials from an open hopper barge, comprising the following steps:

a. providing a barge unloader system comprising a support structure having a compressed gas system, a granular materials handling system and at least one rotating arm having power means for powering said rotating arm, a guide system associated with said support structure, a floating barge lifting platform having component ballast tanks, said floating barge lifting platform movably attached to said guide system, said floating barge lifting platform having any vertical transitory movement and rotational movement controlled by said guide system, and having downward vertical transitory movement imparted by flooding component ballast tanks and upward vertical transitory movement imparted by evacuating component ballast tanks with compressed gas from said compressed gas system, securing means with associated clamp means for clamping comprising clamps for holding an open hopper barge within said floating barge lifting platform;

b. flooding said component ballast tanks of the floating barge lifting platform to sink the floating barge lifting platform to a level sufficient for the barge to be floated onto it;

c. positioning an open hopper barge loaded with granular materials within and over the floating barge lifting platform;

d. positioning said clamp means over the open hopper barge;

e. activating said clamp means to secure the position of the open hopper barge within the floating barge lifting platform;

f. introducing compressed gas from said compressed gas system on board the support structure into the component ballast tanks of the floating barge lifting platform to raise the lifting platform in the guide system relative to the support structure;

g. attaching said rotating arm to the floating barge lifting platform;

h. activating the power means associated with said rotating arm to rotate the floating barge lifting platform about the guide system relative to the support structure to dump the granular material from the open hopper barge onto the granular materials handling system on board the support structure;

i. reversing the power means associated with the rotating arm to rotate back down the floating barge lifting platform about the guide system relative to the support structure to return the floating barge lifting platform to its initial position;

j. releasing the rotating arm from the floating barge lifting platform;

k. deactivating the clamps associated with said securing means to free the open hopper barge positioned within the floating barge lifting platform;

l. releasing the securing means from a position over the open hopper barge;

m. flooding the component ballast tanks of the floating barge lifting platform to sink the floating barge lifting platform to a level which allows the emptied barge to float off of it;

n. floating the empty open hopper barge from the floating barge lifting platform; and o. repeating steps "b" through "n" for subsequent open hopper barges loaded with granular materials to unload them in bulk fashion.

10. A barge unloader system for rapidly unloading granular materials from an open hopper barge, comprising:

a barge support structure having associated submersible and raisable barge support means for picking up a floating, loaded barge and raising it up vertically along side said support structure;

a pivot element supported along side of said support structure; and mechanical arm means for engaging said barge support means and causing it to be pivoted up and over said pivot element causing the load in the barge to be dumped out in bulk fashion, and lowering it back down over said pivot element; and vertical movement means associated with said barge support means for moving said barge support means up to a level where said barge support means can be pivoted over said pivot element and down to a level where said barge support means is submerged down to a sufficient depth for the barge to be floated away, wherein said vertical movement means is an air compressor driven ballast tank floatation system.

11. The barge unloader system of claim 10, wherein there is further included securing means associated with said barge support means for securing the barge to said support means while the barge is being raised, pivoted and lowered back down.

* * * * *